United States Patent [19]

Rodriguez

[11] 4,431,983

[45] Feb. 14, 1984

[54] PTCR PACKAGE

[75] Inventor: George H. Rodriguez, Williamstown, Mass.

[73] Assignee: Sprague Electric Company, North Adams, Mass.

[21] Appl. No.: 323,011

[22] Filed: Nov. 19, 1981

Related U.S. Application Data

[63] Continuation-in-part of Ser. No. 182,565, Aug. 29, 1980, Pat. No. 4,325,051.

[51] Int. Cl.[3] ..... H01C 13/00

[52] U.S. Cl. ..... 338/220; 174/52 R; 338/22 R; 338/309; 338/327; 338/316; 219/541

[58] Field of Search ..... 338/22 SD, 22 R, 22 D, 338/309, 316, 327; 174/52 R; 219/541, 543, 544, 553; 29/593, 611, 612; 339/147 P

[56] References Cited

U.S. PATENT DOCUMENTS

| | | | |
|---|---|---|---|
| 3,743,538 | 7/1973 | Mungaard | 117/221 |
| 3,750,082 | 7/1973 | Peterson et al. | 338/220 |
| 3,794,949 | 2/1974 | Larsen et al. | 338/22 |
| 3,842,188 | 10/1974 | Peterson | 174/52 R |
| 3,914,727 | 11/1975 | Fabricius | 338/22 |
| 3,921,117 | 11/1975 | Blalna | 338/220 X |
| 3,996,447 | 12/1976 | Bouffard et al. | 219/541 |
| 4,053,864 | 10/1977 | Rodriguez et al. | 338/22 |
| 4,200,970 | 5/1980 | Schonberger | 338/22 R X |
| 4,236,065 | 11/1980 | Yashin et al. | 219/544 |
| 4,314,230 | 2/1982 | Cardinal et al. | 338/328 X |
| 4,325,051 | 4/1982 | Rodriguez | 338/220 |

*Primary Examiner*—Volodymyr Y. Mayewsky

[57] ABSTRACT

A ceramic PTCR slug has glass-bonded-aluminum layers bonded to the major opposite surfaces. Patches of silver film are bonded to selected regions of the glass-aluminum layers and stainless steel contacts are spring loaded against the silver patches. The stainless steel contacts provide good thermal isolation to the slug. The low cost contacts are complemented by the minumum use of silver in the electrode. The package provides long life under relatively heavy duty service.

3 Claims, 5 Drawing Figures

PTCR PACKAGE

CROSS REFERENCE TO RELATED APPLICATION

This application is a continuation-in-part of U.S. patent application Ser. No. 182,565 filed Aug. 29, 1980, now U.S. Pat. No. 4,325,051.

BACKGROUND OF THE INVENTION

This invention relates to positive temperature coefficient resistor (PTCR) packages and more particularly to such a package containing a low cost electroded PTCR slug that is pressure contacted by low thermal conductivity metal pieces.

For example it is known to employ a thermally independent PTCR in series with the start winding of a single phase motor whereby the motor is aided in starting by a current flowing in the start winding through the low "cold" resistance of the series connected PTCR. After a short time this current heats the PTCR to the anomaly temperature of the PTCR at which point the PTCR resistance abruptly increases several orders of magnitude causing the current to be diminished accordingly. This is designed to occur just prior to the motor having achieved normal running speed.

A reduced thermal conductivity in a PTCR package leads to reduced power consumption during the steady state running condition, a factor of major importance, e.g. for application in refrigerators, and air conditioners. In PTCR packages designed to handle large currents, e.g. greater than 12 amps., the necessarily heavier electrical conductors between the electroded slug and the package terminals represent a substantial portion of the thermal path between slug and package environment.

This explains, at least in part, why certain manufacturers of PTCR packages have chosen to use stainless steel contacts, stainless steel having a very low thermal conductivity, i.e. 0.08 K cal/sec m °C., compared to that of other metals such as aluminum, copper and carbon steel (0.99, 1.66, and 0.23 K cal/sec m °C., respectively). Beryllium copper also has a low thermal conductivity (0.05) but at least because of associated toxicity problems in its manufacture, berryllium copper is much more (about 3× more) expensive than stainless steel.

However, as will be further elaborated herein, pressure contacts between stainless steel and any of the conventional ceramic electrode metals tend to deteriorate rapidly in a high current carrying PTCR package.

Therefore it is an object of the present invention to provide a reliable PTCR package including stainless steel pressure contacts to the electroded PTCR slug.

It is a further object of this invention to provide a method for making such a package, and more particularly the steps for making suitable electrodes that lead to long life in high current PTCR service.

SUMMARY OF THE INVENTION

Two spaced surface area portions of a PTCR ceramic slug are each covered by a glass-bonded-aluminum layer. Over this layer is a silver containing film that is significantly smaller than the underlying aluminum layer. Spring loaded contacts are forced against the silver patches. These contacts may be of stainless steel. The silver may be used only in the immediate area of the pressure contact, advantageously conserving silver. The aluminum layer, a much less costly material, may be of a generous thickness to achieve a low sheet resistivity and may extend broadly over large surface areas of the slug to make efficient use of the PTCR ceramic. Furthermore, this electrode system permits the use of stainless steel contacts and operates reliably under heavy electrical loads, greater than 12 ampere starting pulses. Most significantly, using stainless steel contacts for optimal thermal isolation of the slug, a long life in heavy duty service is obtained.

The preferred method for electroding the PTCR slug includes applying a paste comprising about 60 weight percent aluminum particles, 30 weight percent of a lead borate glass and 10 weight percent of an organic binder. The slug is then fired at about 760° C. to bond the glass and aluminum mixture to the surface of the slug. The aluminum layers are then lightly abraided. Patches of a silver paste are screen printed over the abraided aluminum layers and fired at about 540° C. Stainless steel contacts are then spring loaded against the silver patches and this assembly is placed into the cavity of a plastic housing. Other metals may be substituted for the stainless steel e.g. beryllium-copper, copper, aluminum, nickel, etc, also providing long service life but either at greater cost or with poorer thermal isolation characteristics.

DESCRIPTION OF THE PREFERRED EMBODIMENTS

Figure 1:
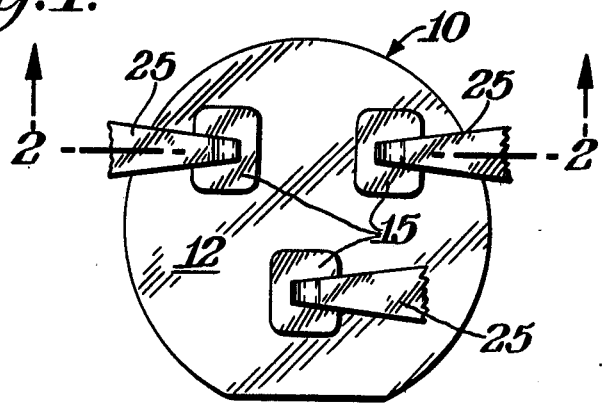
FIG. 1 shows, in side view, a broken-out PTCR slug portion of a PTCR package of this invention.

A series of experiments were performed in an investigation of PTCR electrode systems that would be compatable with stainless steel pressure contacts to provide a reliable PTCR package with a relatively high current rating.

Standard life test conditions for experimental PTCR slug electrode/contact systems were established to reflect expected service conditions and requirements. The contacts were of metal tab stock bent to present to the contacted electrode a slightly rounded convex surface that would have an area of contact with an electrode of 0.006 square inches (3.9 $mm^2$) if it were to have pressed into the electrode to a depth of 0.002 inches (1.3 mm).

The contact force with the electrode was 2 pounds (0.9 Kg). At the above noted hypothetical depth of 0.002 inch in the electrode, the contact area would be 336 p.s.i. (0.24 $Kg/mm^2$). Criterea of this kind are explained in the above-noted patent application Ser. No. 182,565. Pulses of 15 amperes and 2 seconds duration were generated in the series circuit formed by contacts, electrodes and PTCR slug at a rate of one pulse every 30 seconds. Air circulation about the slugs was provided by a fan. The 30 seconds periods with forced air cooling represents an accellerated test rate. The rate experienced by the PTCR package without such cooling in actual service is much less. Success was defined as having five out of five experimental units enduring at least 100,000 cycles on life test.

A group I of experimental PTCR slugs were electroded with a 0.003 inch (0.76 mm) layer of a glass-bonded-aluminum in accordance with the procedure described by Rodriguez and Maher in U.S. Pat. No. 4,053,864 issued Oct. 11, 1977 and assigned to the same assignee as the present invention. Briefly, a mixture of a lead boro-silicate glass frit (66 PbO, 2.6 Al, 8.4 $B_2O_3$, 23 Si) and 8 micron spherical aluminum particles were mixed in an organic vehicle (in weight ratios of 35, 65, and 10 respectively) to form a paste. This paste was screened onto the opposite major faces of disc shaped PTCR slugs of 1.25 inches (31.8 mm) diameter. The slugs were then fired at 1400° F. (760° C.). Stainless steel electrodes were spring loaded against the aluminum electrodes of 5 slugs and subjected to the above described life test.

The first failed at 3000 cycles, the second at 6000 cycles after which this test was terminated. The aluminum electrodes with stainless steel pressure contacts were obviously an unworkable combination.

A group II of experimental PTCR slugs were electroded as follows. A paste mixture of 81 weight percent silver flake, 9 weight percent of the boro-silicate glass and 10 percent vehicle was prepared. To the silver had been added 0.3 weight percent amorphous boron to effect ohmic contact of the silver electrode to the slug. The doping of the silver with boron or another reducing agent is essential for achieving ohmic contact between the silver electrode and the semiconducting ceramic. This paste was screen printed directly onto the opposite major faces of the slugs and fired at 1000° F. (538° C.). Five of these silver electroded slugs were mounted with stainless steel contacts and placed on life test. Failures occurred at 6,000; 9,000; 21,000; 30,000 and 84,000 cycles. Thus silver alone is an unsatisfactory electrode.

Group III PTCR slugs were made by forming glass-bonded-aluminum layers on the slugs just as for the Group I units, and then applying glass-bonded silver films, absent the boron, just as described for the Group II units over the aluminum layers. After assembly with stainless steel electrodes, these assemblies were placed on life test. First failures occurred at 27,000; 30,000 and 39,000 cycles. The remaining two survived 183,000 cycles.

Another group, IV, of experimental units were made following exactly the procedures for making the Group III units except for an added abraiding step prior to applying the silver films. This step consisted in rubbing the aluminum surfaces with a flat-plate-backed 400 grit abrasive paper until the sheen was removed from most of the aluminum surface.

After silvering, firing, mounting with stainless steel contacts and testing, first failures occurred at 222,000 and 231,000 cycles after which the testing was discontinued. This combination of glass-bonded silver over abraided glass-bonded-aluminum clearly works well.

Figure 2:
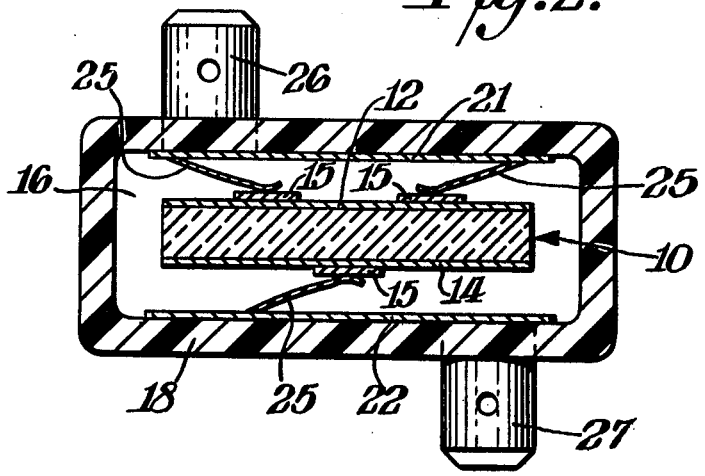
FIG. 2 shows, in top sectional view, the PTCR package of FIG. 1 taken in plane 2—2.

Referring to FIGS. 1 and 2, a disc shaped semiconducting barium titanate PTCR slug 10 has opposite major faces completely covered by two glass-bonded-aluminum layers 12 and 14, respectively. Patches 15 of silver film are bonded to selected regions of each of the aluminum layers 12 and 14.

The slug 10 is inserted into the cavity 16 of a plastic housing 18 along with two stainless steel (#302) sheet metal pieces 21 and 22. Each metal piece 21 and 22 then is punched to form springy metal fingers 25. An electrical spade type terminal 26 and 27 is also formed of pieces 21 and 22, respectively. The terminals extend outwardly through the wall of the housing 18 while each of the fingers is bent so as to be spring loaded against one of the silver film patches 15.

Figure 3:
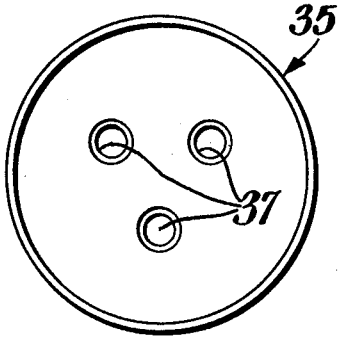
FIG. 3 shows in an inside face view a contacting metal cup of a second package of this invention.
Figure 4:
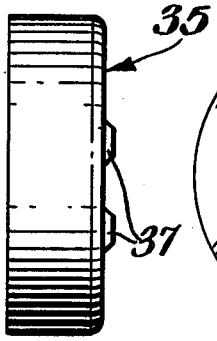
FIG. 4 shows, in side view, the cup of FIG. 3.
Figure 5:
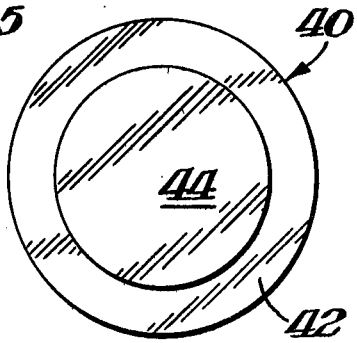
FIG. 5 shows, in face view, a PTCR of the second package for being pressure contacted by the cup of FIGS. 3 and 4.

In FIGS. 3 and 4 an aluminum cup 35 has three mesas 37, formed by bossing, protruding away from the bottom side of the cup. These mesas 37 serve as contacts when assembled with and spring loaded against an electroded face of a PTCR slug 40 as seen in FIG. 5. A glass-bonded-aluminum layer 42 covers the entire top face of the slug 40 while the opposing slug face (not seen) is covered by another aluminum layer (not seen). A silver film patch 44, having a disc shape with a diameter about $\frac{2}{3}$ that of the slug 40, is bonded to a central region of the aluminum layer 42. When the cup 35 and the slug 40 are mounted coaxially as described by the patent to Fabricius U.S. Pat. No. 3,914,727 issued Oct. 21, 1975, the contacts 37 are spring loaded against the silver patch 44. The cup 35 may also be made of stainless steel.

The disc shaped silver patch 44 may have had an annular shape to effect a further economy in the use of silver. An annular silver patch may also be substituted for the silver patches 15 shown in FIG. 1. This would use more silver but would avoid the need for orienting the slug 10 clockwise or counter clockwise with respect to the fingers 25.

What is claimed is:

1. A positive temperature coefficient resistor (PTCR) package comprising a PTCR ceramic slug; two electrodes being bonded to two spaced-apart surface area portions, respectively, of said slug, each of said two electrodes including a glass-bonded aluminum layer adhering to one of said body surface area portions and a silver film patch of substantially less area adhering to said glass-bonded aluminum layer; two spring loaded metal contacts; and a plastic housing enclosing said electrode PTCR slug and holding said spring loaded contacts against said two silver patches, respectively.

2. The PTCR package of claim 1 wherein said each metal contact is stainless steel.

3. The PTCR package of claim 1 wherein said silver containing film patches are comprised of silver particles and glass.

* * * * *